United States Patent [19]

Wessel et al.

[11] 4,236,997

[45] Dec. 2, 1980

[54] AIR SEPARATOR APPARATUS

[75] Inventors: Josef A Wessel, Am Sonnenhof 154, 8131 Aüfkirchen, Fed. Rep. of Germany; Manfred Müller; Otto Heinemann, both of Ennigerloh, Fed. Rep. of Germany; Norbert Bredenholler, Oelde, Fed. Rep. of Germany

[73] Assignees: Josef Wessel, Aüfkirchen; Polysius AG, Beckum, both of Fed. Rep. of Germany

[21] Appl. No.: 29,457

[22] Filed: Apr. 12, 1979

[30] Foreign Application Priority Data

Apr. 22, 1978 [DE] Fed. Rep. of Germany ..... 2817725

[51] Int. Cl.[3] ..... B07B 7/083

[52] U.S. Cl. ..... 209/144; 209/145

[58] Field of Search ..... 209/144–148

[56] References Cited

U.S. PATENT DOCUMENTS

| | | | |
|---|---|---|---|
| 2,943,735 | 7/1960 | Payne et al. | 209/144 |
| 3,891,543 | 6/1975 | Wessel | 209/144 |

FOREIGN PATENT DOCUMENTS

| | | | |
|---|---|---|---|
| 2225258 | 2/1973 | Fed. Rep. of Germany | 209/144 |
| 2551175 | 5/1977 | Fed. Rep. of Germany | 209/144 |
| 253794 | 7/1927 | Italy | 209/145 |
| 694219 | 7/1953 | United Kingdom | 209/144 |

*Primary Examiner*—Ralph J. Hill

*Attorney, Agent, or Firm*—Learman & McCulloch

[57] ABSTRACT

The invention relates to an air separator having a rotor provided with feed passages for the material to be separated which extend radially outward and between which extraction openings are arranged. The space between adjacent feed passages which exists between the outer end of the feed passages and the extraction openings is axially delimited on at least one side by a stationary element forming part of an extraction housing. In this way, problems of wear in the outer region of the rotor are reduced. In addition, there is no longer any need for an exact sealing gap to be maintained between the rotor and the extraction housing. Finally, the free flow cross-section for the separation air is increased for the same overall dimensions of the separator.

23 Claims, 8 Drawing Figures

FIG.6
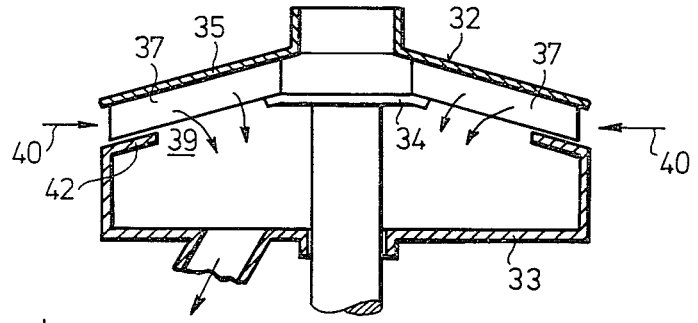
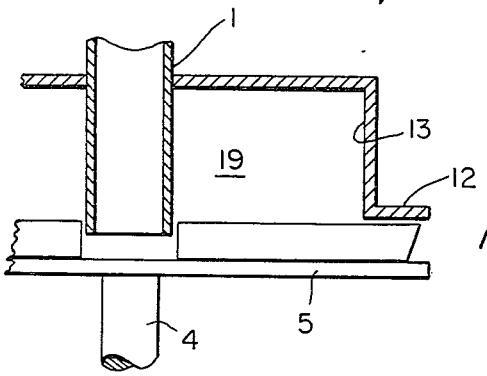
FIG. 8
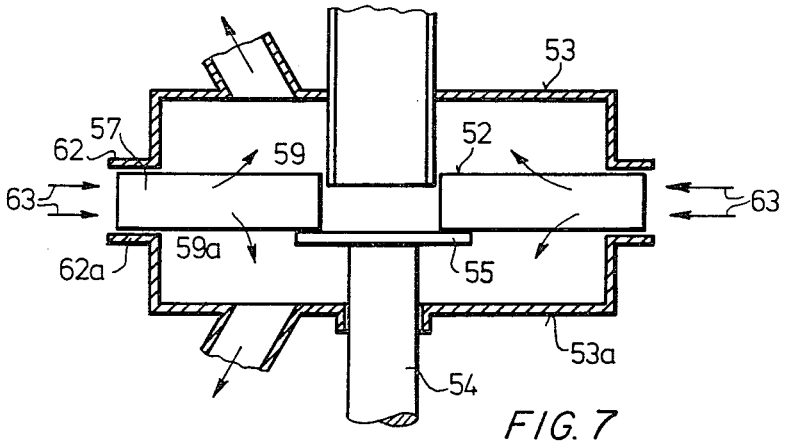
FIG. 7

AIR SEPARATOR APPARATUS

BACKGROUND OF THE INVENTION

This invention relates to air separator apparatus comprising a rotor adapted to be charged centrally with material to be separated and having feed passages extending radially outward for the material to be separated and extraction openings arranged between such feed passages. The apparatus comprises at least one extraction housing fixedly arranged in axial extension of the rotor and adjoining the extraction openings of the rotor, thereby enabling separation air to flow substantially inward through the space situated between adjacent feed passages and enter the extraction housing together with the fine material through the extraction openings of the rotor, while the coarse material is thrown outward.

One air separator of the general type to which the invention relates is described for example in German Pat. No. 2,225,258. It is distinguished from other known types by a considerably higher throughput of material to be separated for the same diameter and by a relatively simple construction.

In the air separator described in German Pat. No. 2,225,258, the rotor consists essentially of two cover discs between which several ribs are radially arranged to form feed passages for the material to be separated. One of the two cover discs is provided between adjacent feed passages with openings forming the extraction openings of the rotor through which the separation air enters the stationary extraction housing arranged below the rotor together with the fine material. In this known separator, therefore, the space situated between the outer end of the feed passages and the extraction openings is axially delimited by one of the cover discs of the rotor.

The above-mentioned outer annular region of the lower cover disc of the rotor according to German Pat. No. 2,225,258 inevitably undergoes a certain amount of wear in operation, both on its upper surface delimiting the flow space for the material to be separated and also on its lower surface which, together with the opposite stationary wall of the extraction housing, forms a sealing gap. In addition, it becomes increasingly more difficult from the constructional point of view to maintain the required sealing gap with increasing rotor diameter.

SUMMARY OF THE INVENTION

The objects of the present invention are further to improve the air separator according to German Pat. No. 2,225,258, while retaining its basic advantages, in such a manner that the problems attendant wear in the outer region of the rotor are reduced, there is no longer any need to maintain a sealing gap betweeen the rotor and the extraction housing, and finally, the free flow cross-section for the separation air is increased for the same overall dimensions of the separator.

According to the invention these objects are achieved in that the space between adjacent feed passages which is situated between the outer end of the feed passages and the extraction openings is axially delimited on at least one side by a stationary element, preferably by a wall of the extractionhousing. According to the invention the wall of the extraction housing, which is present in any case, replaces part of the rotor (i.e., the lower cover disc) and takes over the function performed by this part of the rotor of axially delimiting the flow path of the separation air and the fine material toward the side of the extraction housing until the separation air and the fine material are able to enter the extraction housings through the extraction openings of the rotor. By eliminating this wearing part, maintenance is considerably simplified.

Another advantage afforded by the invention is that it eliminates the need to maintain an exact sealing gap between that side of the rotor facing the extraction housing and the extraction housing itself. Finally, the increase in the free flow cross-section of the separation air which is obtained by elimination of one of the rotor cover discs has a favorable effect on the required increase in performance.

DESCRIPTION OF THE DRAWINGS

These and other features of the invention are described hereinafter and are disclosed in the accompanying drawings, wherein:

FIG. 6 is a vertical section through an embodiment with extraction openings arranged along a conical surface;

FIG. 7 is a vertical section through an embodiment of an air separator according to the invention with extraction on both sides; and FIG. 8 is a fragmentary view similar to FIG. 1, but illustrating a modification.

DETAILED DESCRIPTION

Figure 1:
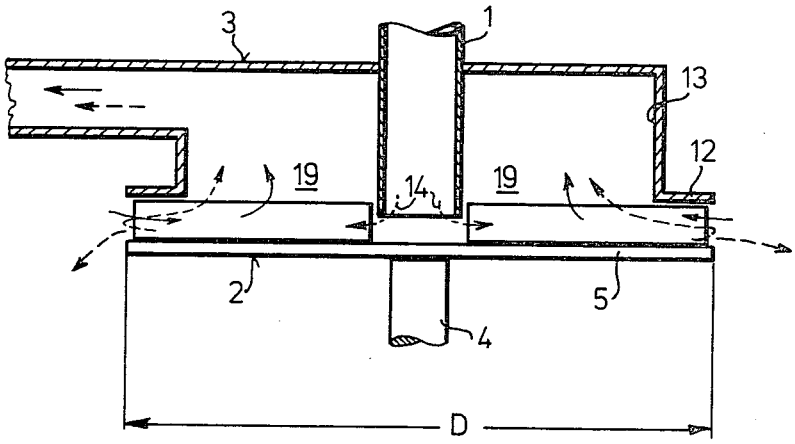
FIG. 1 is a vertical section through a first embodiment of those parts of an air separator with which the invention is concerned (namely, the rotor and extraction housing)
Figure 3:
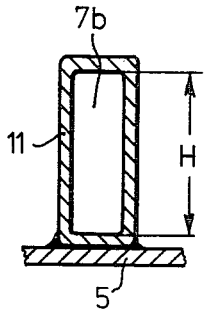
FIG. 3 is a section on the line III—III of FIG. 2.
Figure 2:
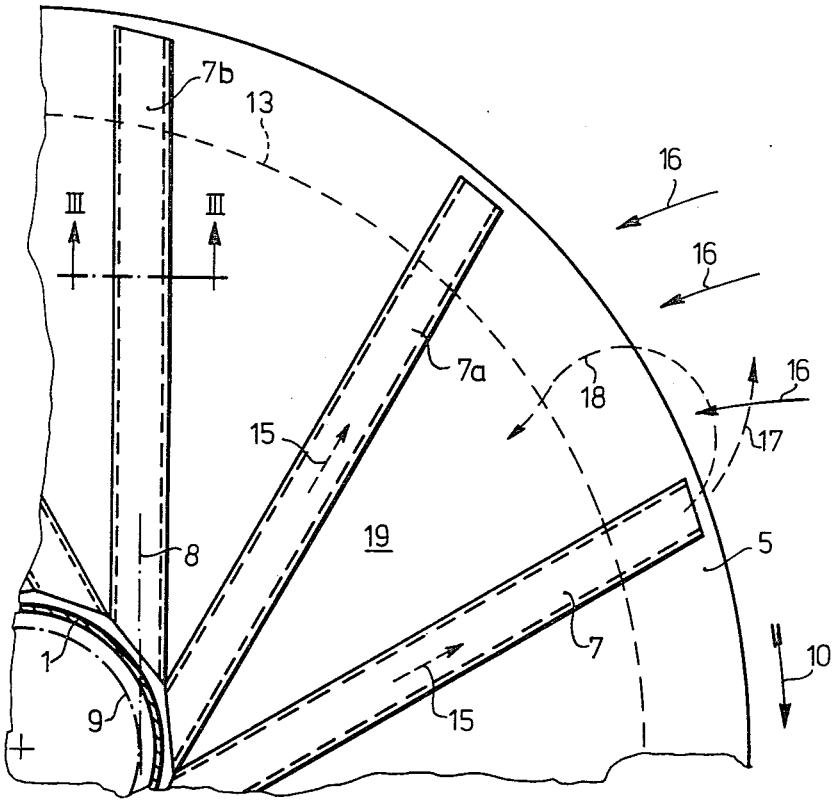
FIG. 2 is a partial plan view of the rotor shown in FIG. 1.

The air separator, of which those parts essential for understanding the invention are diagrammatically illustrated in FIGS. 1 to 3, comprises a central rotor 2 charged with material to be separated from above through a feed pipe 1 and an extraction housing 3 fixedly arranged over the rotor in axial extension thereof. A continuous flow of extraction air is drawn through the housing 3 by means of a suction fan (not shown) in communication with the interior of the housing, as is conventional.

The rotor 2 is driven from below via a shaft 4 and a base plate 5 which carries a number of feed passages 7, *7a*, *7b*, etc., which extend generally radially outward and of which the axis 8 tangentially adjoins an imaginary circle 9 lying in the outer region of the central feed pipe 1. The feed passages 7, *7a*, *7b*, etc., for the material to be separated slope rearward in the direction of rotation of the rotor, indicated by the arrow 10.

In the embodiment illustrated in FIGS. 1 to 3, the feed passages 7, *7a*, *7b*, etc., for the material to be separated are formed by hollow profile sections 11 closed on all sides (cf. FIG. 3).

On that side facing the rotor 2, the stationary extraction housing 3 comprises in its outer region a flange 12 which confronts the outer annular zone of the rotor 2. The inner edge 13 of the extraction housing 3 is shown in chain lines in FIG. 2.

Accordingly, the air separator operates as follows:

The material to be separated, which is delivered to the rotor 2 through the pipe 1 (arrows 14), is thrown outward (arrows 15) into the feed passages 7, *7a*, *7b* by the rotational movement of the rotor and, on leaving these feed passages, is taken up by the separation air drawn in from outside (arrows 16). Whereas the coarse material is thrown outward (arrow 17), the separation air takes up the fine material (arrows 18) and entrains it into the flow space between adjacent feed passages. That part of this flow space which is initially traversed by the separation air and the fine material is delimited on top by the flange 12 of the stationary extraction housing 3. Once the separation air has reached the edge 13 of the extraction housing 3, it may flow into the extraction housing 3 with the fine material through the extraction opening 19 now present. The extraction opening 19 between the feed passages 7 and *7a* is emphasized in FIG. 2; it should be noted that this extraction opening revolves with the rotation of the rotor 2.

In the air separator according to the invention, therefore, the space between adjacent feed passages which is situated between the outer end of the feed passages 7, *7a*, *7b*, etc., and the extraction openings 19 is delimited on that side facing the extraction housing 3 by a stationary element, i.e., the flange 12 of the extraction housing.

As shown in FIG. 2, the feed passages 7, *7a*, *7b*, etc., terminate close to the outer periphery of the baseplate 5 of the rotor 2 and the flange 12 of the extraction housing 3. The resulting increase in the length of the feed passages, as compared to known constructions, provides for better disintegration and acceleration of the material to be separated, which enables the rotational speed of the rotor to be reduced for the same separation effect. In addition, an increase in the outer circumference of the extraction openings 19 and, hence, an increase in the critical flow cross-section for the separation air are obtained in this way.

Figure 4:
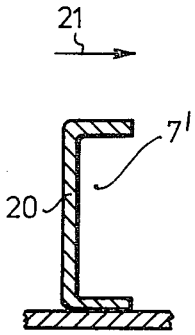
FIG. 4 is a section through a modified embodiment of a feed passage for the material to be separated.

FIG. 4 shows a modified embodiment of feed passage 7' for the material to be separated which is formed by a substantially C-shaped hollow profile 20 open on one side. In this case, the rotor rotates in the direction of the arrow 21, so that the open side of the hollow profile 20 leads in the direction of rotation of the rotor. The arrangement and rotational speed are suitably selected so that the material to be separated is externally held and guided by the Coriolis force in the feed passage 7' during its movement therethrough. An open feed-passage construction such as this is distinguished by high operational reliability (no blockages) and by particularly low wear.

Figure 5:
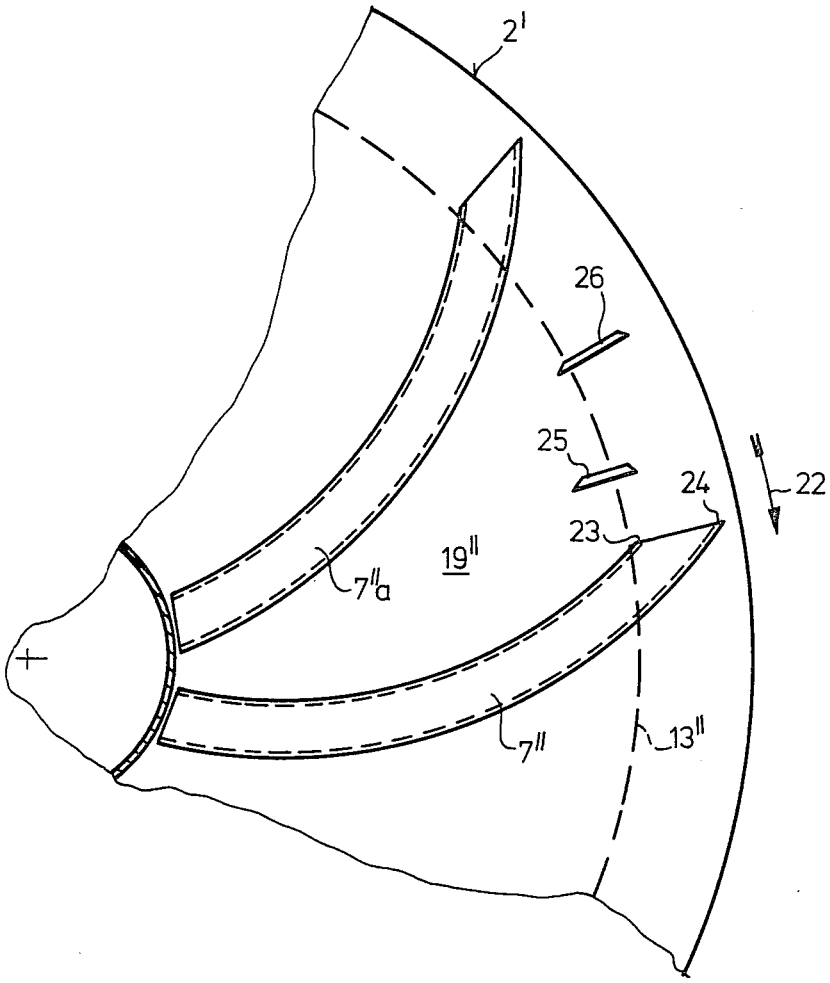
FIG. 5 is a plan view of a rotor with curved feed passages.

FIG. 5 shows an embodiment of rotor 2' of which the feed passages 7'', 7''*a* are curved and slope rearward in the direction of rotation of the rotor (arrow 22). In this embodiment, the trailing boundary edge 23 of the feed passages (looking in the direction of rotation of the rotor) is offset radially inward in relation to the leading boundary edge 24. By virtue of the curved arrangement, the required fineness of separation can be obtained at a lower rotational speed. In addition, a maximum outlet angle of the material relative to the radius vector is obtained, which improves the efficiency of separation.

In addition, guide elements 25, 26 which guide the separation air flowing in are provided between adjacent feed passages in the space existing between the outer end of the feed passages and the extraction openings 19''. The inner edge of the extraction housing 3 which delimits the extraction openings 19'' is denoted by the reference 13''.

Whereas, in the embodiments described above, the separation air is extracted upward, FIG. 6 shows an embodiment in which the separation air is extracted downward. In this case, the extraction housing 33 is arranged below the rotor 32. This rotor 32 essentially comprises a central scattering plate 34, a conical hood 35, and a number of radially extending feed passages 37 which are formed by linear or curved, closed or open hollow profile sections.

In contrast to the previous embodiments, the extraction openings 39 of the rotor in the embodiment shown in FIG. 6 are situated along an imaginary conical surface of which the tip points from the extraction housing 33 to the rotor 32. It can clearly be seen from FIG. 6 that a particularly favorable air distribution and particularly smooth, turbulence-free flow of the separation air (arrows 40) into extraction housing 33 are obtained in this way. Stabilizing the air flow improves selectivity.

In this embodiment, the inclination of the conical hood 35 corresponds to the inclination of the above-mentioned conical surface along which the extraction openings 39 are arranged. However, it is obvious that the inclination of the conical hood 35 could be less. The upper boundary surface of the rotor 32 may also be formed by a flat disc extending perpendicularly of the rotor axis. In this case, the cross-section of the feed passages widens outward.

In the embodiment shown in FIG. 6, the space between adjacent feed passages which exists between the outer end of the feed passages 37 and the extraction openings 39 is also delimited by a flange 42 secured to the stationary extraction housing 33. The embodiment shown in FIG. 6 may also be modified to the extend that the lower edge of the feed passages in the outer region and, hence, the flange 42 extend horizontally.

FIG. 7 shows an embodiment in which one extraction housing 53 is arranged on one side and another extraction housing 53*a* on the other side of a rotor 52 driven from below by a shaft 54. On a baseplate 55, simultaneously acting as scattering plate, the rotor 52 carries a number of radially extending feed passages 57 which, as in the previous embodiments, extend linearly or are curved and may be formed by open or closed hollow profile sections.

The space between the outer end of the feed passages 57 and the extraction openings 59 and 59*a* is delimited on the upper and lower sides of the rotor by flanges 62 and 62*a* belonging to the extraction housings 53 and 53*a*, respectively. The separation air is extracted upward and downward (arrows 63).

In all the described embodiments, the hollow profile sections forming the feed passages may be made of an extruded material. This is particularly advisable where the feed passages extend linearly (cf. FIG. 2) because, in this case, the feed passages may be produced simply by cutting from extruded material.

The profile sections forming the feed passages may also be made of plastics providing adequate temperature resistance and resistance to wear are guaranteed. To this end, plastics profile sections may be reinforced on those surfaces which are exposed to increased wear. It is also possible, however, for the profile sections forming the feed passages to be made of a highly wear-resistant material (such as ceramic materials, cast basalt etc.), preferably by extrusion.

Another factor of importance to the optimum operation of the separator is the correct choice of the ratio between the width of the feed passages in the axial direction of the rotor (height H, cf. FIG. 3) and the rotor diameter (D in FIG. 1). Where the separation air is extracted on one side (embodiments of FIGS. 1 to 6), the H:D ratio should be between 1:4 and 1:15 and preferably between about 1:7 and 1:12.

Where the separation air is extracted on both sides (embodiment of FIG. 7), the H:D ration should be between 1:2 and 1:10 and preferably between about 1:3.5 and 1:7.

In any embodiment of the invention, the outer opening of the feed passages may be slightly inclined in relation to the axis of the separator so that that edge of this opening which is remote from the extraction opening lies on a somewhat smaller diameter than its edge facing the extraction opening. See FIG. 8. In this way, the somewhat nonuniform airflow velocity encountered in passages of considerable height (somewhat higher near the extraction opening than on that side remote from the extraction opening) is compensated for and, hence, selectivity is increased.

We claim:

1. An air separator comprising at least one stationary extraction housing having a peripheral wall and being open at one end; a rotor adjacent said open end of said housing having one face of said rotor confronting said housing; means for charging said one face of said rotor centrally through said housing with material to be separated; a plurality of circumferentially spaced feed passages on said face of said rotor communicating with said charging means and extending substantially radially thereof beyond the peripheral wall of said housing to form spaces between adjacent passages; means for drawing extraction air through said spaces into and out of said housing; and stationary means adjoining said passages and overlying those portions of said passages which extend beyond said peripheral wall of said housing and axially delimiting said spaces to form extraction openings between adjacent passages.

2. An air separator as claimed in claim 1 wherein said stationary means is formed by a wall of the extraction housing.

3. An air separator as claimed in claim 1 wherein said housing and said stationary means are duplicated at the opposite face of said rotor.

4. An air separator as claimed in claim 1 wherein the ratio between the width of the feed passages in the axial direction of the rotor and the rotor diameter is between 1:7 and 1:12.

5. An air separator as claimed in claim 1 wherein the feed passages for the materials to be separated extend linearly and slope rearward in the direction of rotation of the rotor, said feed passages adjoining substantially tangentially an imaginary circle lying in the outer region of the charging means.

6. An air separator as claimed in claim 1 wherein the feed passages for the material to be separated are curved and slope rearward in the direction of rotation of the rotor.

7. An air separator as claimed in claim 1 wherein the feed passages for the material to be separated are formed by hollow profile sections.

8. An air separator as claimed in claim 7 wherein the hollow profile sections are closed on all sides.

9. An air separator as claimed in claim 7 wherein the hollow profile sections are at least partly open on their leading side looking in the direction of rotation of the rotor.

10. An air separator as claimed in claim 1 including guide elements provided in the spaces between adjacent feed passages adjacent the radially outer ends of said feed passages.

11. An air separator as claimed in claim 1 wherein the trailing boundary edge of the feed passages is offset radially inward in relation to the leading boundary edge.

12. An air separator as claimed in claim 1 wherein the feed passages terminate radially inwardly of the outer periphery of the stationary delimiting means.

13. An air separator as claimed in claim 1 wherein said feed passages are formed of extruded material.

14. An air separator as claimed in claim 1 wherein the feed passages are formed of a plastics material.

15. An air separator as claimed in claim 14 wherein the plastics material is reinforced on those surfaces exposed to wear by material to be separated.

16. An air separator as claimed in claim 1 wherein the feed passages are made of a highly wear-resistant material such as ceramic or cast basalt.

17. An air separator as claimed in claim 1 wherein the ratio between the width of the feed passages in the axial direction of the rotor and the rotor diameter is between 1:4 and 1:15 and preferably between 1:7 and 1:12.

18. An air separator as claimed in claim 1 wherein the ratio between the width of the feed passages in the axial direction of the rotor and the rotor diameter is between 1:2 and 1:10 and preferably to between 1:3.5 and 1:7.

19. An air separator as claimed in claim 1 wherein the extraction openings of the rotor are situated along an imaginary conical surface of which the tip points from the extraction housing to the rotor.

20. An air separator as claimed in claim 19 wherein the stationary means delimiting the space between adjacent feed passages is formed by a conical hood of which the inclination is at most equal to that of the imaginary conical surface along which the extraction openings of the rotor are situated.

21. An air separator as claimed in claim 1 wherein the stationary means delimiting space between adjacent feed passages is formed by a plate arranged perpendicularly of the rotor axis.

22. An air separator as claimed in claim 1 wherein the outer opening of each feed passage is slightly inclined relative to the separator axis, that edge of such opening which is remote from the extraction opening lying on a somewhat smaller diameter than its edge which faces the extraction opening.

23. An air separator as claimed in claim 1 wherein the ratio between the width of the feed passages in the axial direction of the rotor and the rotor diameter is between 1:3.5 and 1:7.

* * * * *